US010801276B2

(12) United States Patent
Bergeron et al.

(10) Patent No.: US 10,801,276 B2
(45) Date of Patent: Oct. 13, 2020

(54) ELEVATOR LINK COMPENSATOR SYSTEMS AND METHODS

(71) Applicant: Nabors Drilling Technologies USA, Inc., Houston, TX (US)

(72) Inventors: Jamie Bergeron, Youngsville, LA (US); Hendrik Schalk Le Roux, Lafayette, LA (US)

(73) Assignee: Nabors Drilling Technologies USA, Inc., Houston, TX (US)

( * ) Notice: Subject to any disclaimer, the term of this patent is extended or adjusted under 35 U.S.C. 154(b) by 108 days.

(21) Appl. No.: 15/875,488

(22) Filed: Jan. 19, 2018

(65) Prior Publication Data

US 2018/0209226 A1 Jul. 26, 2018

Related U.S. Application Data

(60) Provisional application No. 62/449,970, filed on Jan. 24, 2017.

(51) Int. Cl.

| | |
|---|---|
| ***E21B 19/06*** | (2006.01) |
| ***E21B 19/10*** | (2006.01) |
| ***E21B 19/08*** | (2006.01) |
| ***E21B 19/16*** | (2006.01) |

(52) U.S. Cl.
CPC ..... *E21B 19/06* (2013.01); *E21B 19/08* (2013.01); *E21B 19/10* (2013.01); *E21B 19/16* (2013.01)

(58) Field of Classification Search
CPC ..... E21B 19/06; E21B 19/08; E21B 19/10; E21B 19/16
USPC ..... 166/77.52
See application file for complete search history.

(56) References Cited

U.S. PATENT DOCUMENTS

| | | | | |
|---|---|---|---|---|
| 7,673,675 | B2 | 3/2010 | Carr et al. | |
| 8,752,636 | B2 | 6/2014 | Liess et al. | |
| 2007/0119035 | A1 | 5/2007 | Moncus et al. | |
| 2013/0105168 | A1* | 5/2013 | Overland | E21B 19/07 166/352 |
| 2013/0292136 | A1 | 11/2013 | McIntosh et al. | |

FOREIGN PATENT DOCUMENTS

| | | | |
|---|---|---|---|
| GB | 2480396 | A | 11/2011 |

* cited by examiner

*Primary Examiner* — Matthew R Buck
*Assistant Examiner* — Patrick F Lambe
(74) *Attorney, Agent, or Firm* — Abel Schillinger, LLP; Enrique Abarca

(57) ABSTRACT

Embodiments of the present disclosure are directed to systems and methods for running casing into a wellbore with a casing running tool (CRT), such as a casing drive system (CDS), that is equipped with single joint elevator links and elevators. For example, in certain embodiments, a system includes a joint elevator configured to engage a joint of a tubular element. The system also includes an elevator link comprising an upper link and a lower link. The lower link is configured to couple to the joint elevator. In addition, the lower link is configured to fit telescopically within the upper link. The system further includes a compensator cylinder configured to couple to the upper link and the lower link, and configured to adjust a position of the lower link with respect to the upper link.

20 Claims, 6 Drawing Sheets

ELEVATOR LINK COMPENSATOR SYSTEMS AND METHODS

CROSS REFERENCE TO RELATED APPLICATION

This application is a U.S. Non-Provisional Patent Application claiming priority to U.S. Provisional Patent Application No. 62/449,970, entitled "ELEVATOR LINKS COMPENSATOR SYSTEM AND METHOD," filed Jan. 24, 2017, which is hereby incorporated by reference in its entirety for all purposes.

BACKGROUND

Embodiments of the present disclosure are directed to systems and methods for running casing into a wellbore with a casing running tool (CRT), such as a casing drive system (CDS), that is equipped with single joint elevator links and elevators.

When casing is run into a pre-drilled well, single joints of the casing are continuously added to the top of the casing to make up the casing string. The casing string is suspended from casing floor slips while a new casing joint is added to the casing string. When a CRT is used to run a new casing joint into a well, the single joints of casing are picked up in a single joint (SJ) casing elevator while the SJ casing elevator is suspended by a set of elevator links that extend downward from the CRT. The whole CRT with links, elevator, and joint of casing is hoisted by the draw works of the drilling rig. The draw works of a rig is extremely powerful, and may sometimes lift weights up to 1,200 tons. Thus, fine control of the draw works may prove relatively difficult. However, fine control of the hoisting and lowering of the joint of casing during the make-up of a connection between the new single joint and the casing string may be desirable to avoid degradation of threads of the casing connection (e.g., between the single joint of casing and the CRT). Further, if there is miscommunication between the driller and the CRT operator, the CRT with links and elevator may be exposed to the complete casing string weight, which may lead to degradation of these components. For example, if the CRT operator does not open the elevator and the driller hoists the CRT with the draw works after the connection between the new casing joint and the casing string is made, the CRT with links and elevator will be exposed to the weight of the whole casing string. The typical load rating of the links and elevator on a CRT is on the order of 6 tons. Therefore, one or more of the components mentioned above may exceed a desired loading if exposed to the weight of the whole casing string.

BRIEF DESCRIPTION

In accordance with one embodiment of the disclosure, a system includes a joint elevator configured to engage a joint of a tubular element. The system also includes an elevator link comprising an upper link and a lower link. The lower link is configured to couple to the joint elevator. In addition, the lower link is configured to fit telescopically within the upper link. The system further includes a compensator cylinder configured to couple to the upper link and the lower link, and configured to adjust a position of the lower link with respect to the upper link.

In accordance with another embodiment of the disclosure, a system includes a joint elevator configured to engage a joint of a tubular element. The system also includes an elevator link comprising an upper link and a lower link. The lower link is configured to couple to the joint elevator. In addition, the lower link is configured to fit telescopically within the upper link. The system further includes a compensator cylinder configured to couple to the upper link and the lower link, and configured to adjust a position of the lower link with respect to the upper link. The system also includes a hydraulic control system configured to adjust a fluid pressure within the compensator cylinder to expand or retract the compensator cylinder.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Present embodiments include a compensator link assembly that may provide flexibility in the links so the driller can stop the draw works before the casing running tool, links, and elevators are exposed to the casing string weight. As described herein, the compensator link assembly may be controlled with a passive hydraulic control system having pre-charged accumulators, or with an active hydraulic control system. When controlled with an active hydraulic control system, the compensator link assembly may further provide for fine control when lowering the pin end of the new casing joint (held by the elevators) into the box end on the casing stump. Similarly, it may provide fine control when hoisting the pin end of the casing joint from the box end on the stump if this operation is necessary.

Figure 1:
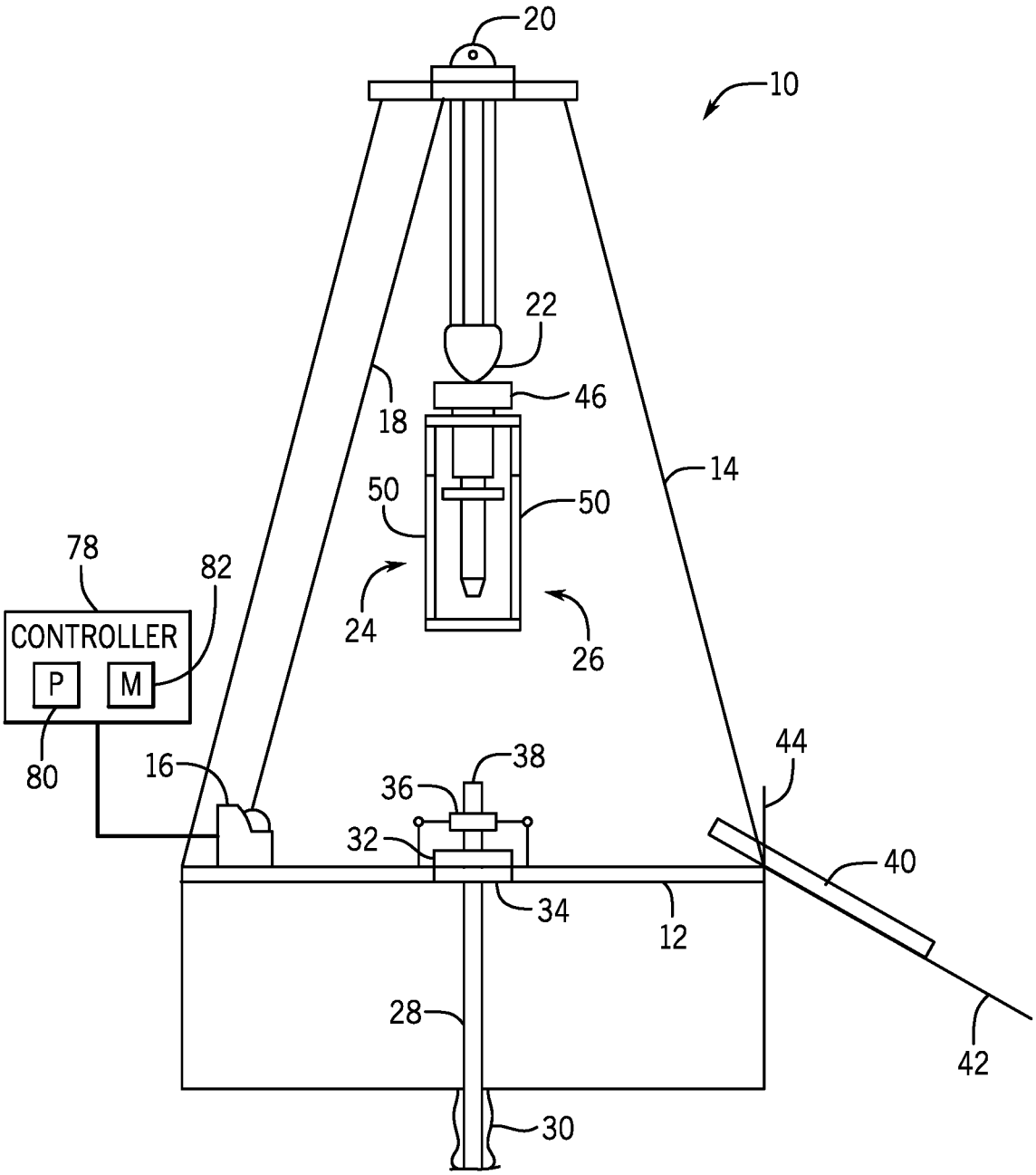
FIG. 1 is a schematic representation of a drilling rig in the process of drilling a well, in accordance with present techniques.

Turning now to the drawings, FIG. 1 is a schematic representation of a drilling rig 10 in the process of drilling a well, in accordance with present techniques. The drilling rig 10 features an elevated rig floor 12 and a derrick 14 extending above the elevated rig floor 12. A draw works 16 regulates an amount of drilling line 18 that is supplied to a crown block 20 and traveling block 22 configured to hoist various types of drilling equipment above the rig floor 12 and, consequently, regulates the height of the traveling block 22 at any given moment. Below the rig floor 12, a tubular string 28 (i.e., casing string) extends downward into a wellbore 30 and is held stationary with respect to the rig floor 12 by a spider or power slips 32 of a rotary table 34. In certain embodiments, power tongs 36 may be located above the rig floor 12 to apply a torque for making up new lengths of tubular. A portion of the tubular string 28 extends above the rig floor 12, forming a stump 38 to which another tubular element 40 (e.g., a single joint of casing or drill pipe) may be added.

In present embodiments, as the rotary table 34 rotates the tubular string 28, a casing running tool, such as a casing drive system (CDS) 24, is engaged with the tubular string 28 (via a pipe handling device 26 of the CDS 24) to support the tubular string 28. The pipe handling device 26 may be configured to rotate freely with respect to the rest of the CDS 24 as the tubular string 28 rotates. A new tubular element 40 may be brought to the rig floor 12 via a pipe ramp 42. The CDS 24 may be lowered to a V-door 44 of the drilling rig 10, where the CDS 24 engages the tubular element 40 using the pipe handling device 26. In certain embodiments, the pipe handling device 26 may be actuated to grip and to provide a hydraulic seal to the tubular element 40. The tubular element 40 may be lifted from the V-door 44 via the CDS 24, and lowered onto the stump 38 to make the next connection of the tubular string 28.

In the embodiment illustrated in FIG. 1, the CDS 24 includes a top drive 46, which may include one or more motors configured to facilitate the rotation of the tubular string 28 at a desired speed. However, it should be noted that the presently disclosed CDS 24 may include any other type of drive that rotates the tubular string 28 from the rig floor 12. In addition, the CDS 24 may be applied to drilling rigs 10 of any relative size, including heavy or light duty rigs, workover rigs, servicing rigs, completion rigs, and so forth.

It should also be noted that the drilling rig 10 illustrated in FIG. 1 is intentionally simplified to focus on the CDS 24 described in the present disclosure. Many other components and tools may be employed during the various periods of formation and preparation of the wellbore 30. Similarly, the environment of the wellbore 30 may vary widely depending upon the location and situation of the formations of interest. For example, rather than a surface (land-based) operation, the wellbore 30 may be formed under water of various depths, in which case the topside equipment may include an anchored or floating platform.

Figure 2:
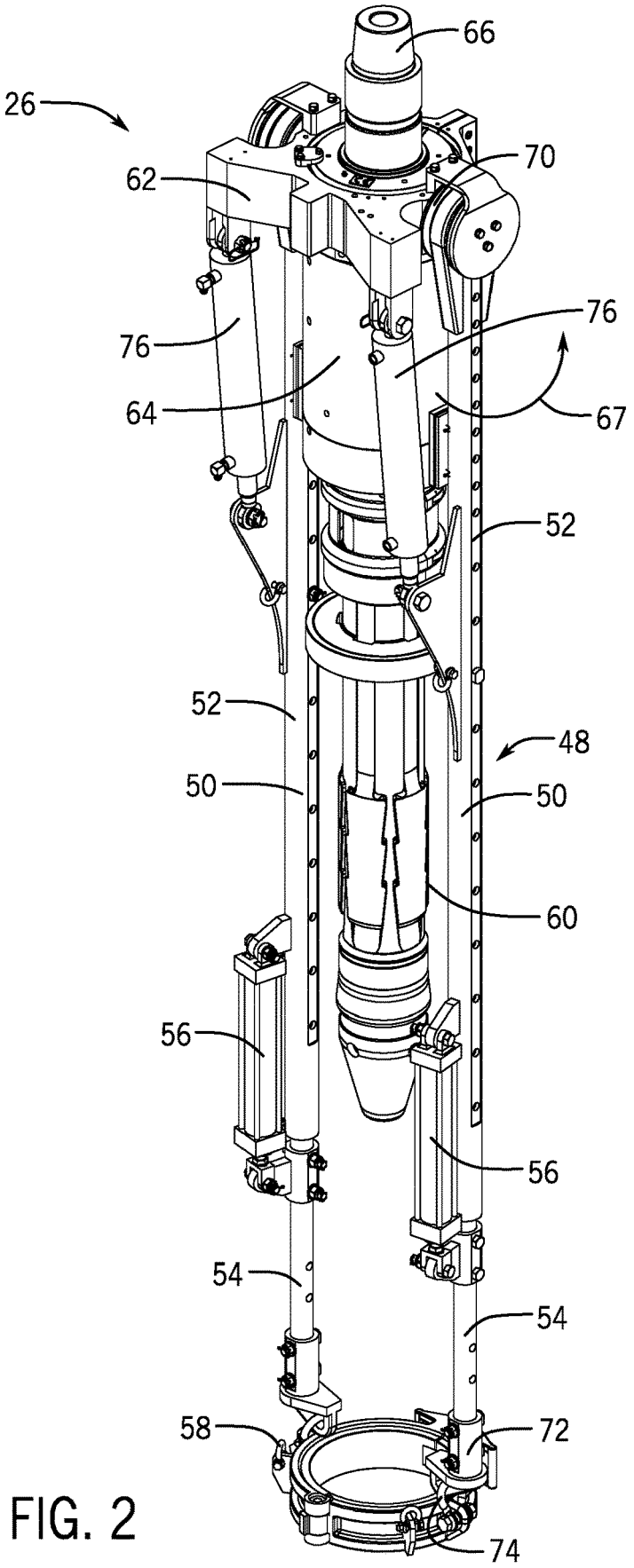
FIG. 2 is a perspective view of an embodiment of a pipe handling device of a casing drive system (CDS) with a compensator link assembly, in accordance with present techniques.

FIG. 2 is a perspective view of an embodiment of the pipe handling device 26 of the CDS 24 used to manipulate the tubular element 40 about the drilling rig 10, in accordance with present techniques. In certain embodiments, the pipe handling device 26 may include certain components similar to the components pipe handling devices described in U.S. Pat. No. 7,673,675, issued to Tesco Corporation on Mar. 9, 2010, which is hereby incorporated by reference in its entirety. In the embodiment illustrated in FIG. 2, the pipe handling device 26 includes a compensator link assembly 48 that includes a pair of elevator links 50 (i.e., elevator links), each elevator link 50 including upper and lower links 52, 54 and a compensator system 56. Axial ends of each of the elevator links 50 are pivotally connected to a single joint elevator 58 configured to engage a single joint of the tubular element 40 while a pipe gripping mechanism 60 of the pipe handling device 26 engages (e.g., grips) the single joint of the tubular element 40. More specifically, axial ends of the lower links 54 are connected to the single joint elevator 58.

As illustrated, opposite axial ends of each of the elevator links 50 are pivotally connected to a link tilt hanger plate 62 that is, in turn, connected to a main housing 64 of the pipe handling device 26, which supports the pipe gripping mechanism 60. More specifically, axial ends of the upper links 52 are connected to the link tilt hanger plate 62. In certain embodiments, the connection between the link tilt hanger plate 62 and the main housing 64 of the pipe handling device 26 may substantially prevent the link tilt hanger plate 62 from rotating with the pipe gripping mechanism 60 in certain situations. For example, in certain embodiments, the connection between the link tilt hanger plate 62 and the main housing 64 of the pipe handling device 26 may be formed to provide torque limiting breakaway in response to the application of torque beyond a selected maximum, for example, from the top drive 46 of the CDS 24 to the pair of elevator links 50 through the main housing 64 of the pipe handling device 26.

As illustrated in FIG. 2, the pipe handling device 26 includes the pipe gripping mechanism 60, which may be an internal gripping tool configured to engage (e.g., grip) an inner wall of a tubular element 40, and which may be rotatable relative to the main housing 64 of the pipe handling device 26 via, for example, an actuator disposed within the main housing 64. In certain embodiments, the pipe handling device 26 may include a mandrel 66 configured to be connected to the top drive 46 of the CDS 24 such that the top drive 46 may transmit rotational and axial movement to the mandrel 66.

Again, the pair of elevator links 50 may be mounted to the link tilt hanger plate 62 such that pivotal movement of the elevator links 50 are enabled relative to the link tilt hanger plate 62, as illustrated by arrow 67. For example, in certain embodiments, as described herein, each of the upper links 52 may include circular eye holes 68 that may be configured to mate with circular trunnions 70 on opposite sides of the link tilt hanger plate 62 to facilitate the pivotal movement of the elevator links 50 relative to the link tilt hanger plate 62. It will be appreciated that, in certain embodiments, the circular trunnions 70 are coaxial such that the elevator links 50 rotate in planes parallel to each other. In addition, in certain embodiments, each of the lower links 54 may include a pivot block 72, which may include a pad eye 74 for facilitating connection to the single joint elevator 58.

In addition, in certain embodiments, the pipe handling device 26 may include a drive system for driving the pair of elevator links 50 to rotate about their respective circular trunnions 70. For example, in certain embodiments, the drive system may include a pair of link tilt cylinders 76, each link tilt cylinder 76 connected between the link tilt hanger plate 62 and the respective elevator link 50. In particular, as illustrated, each link tilt cylinder 76 may be connected to the associated upper link 52 of the respective elevator link 50. In certain embodiments, the link tilt cylinders 76 may be driven by fluid received through fluid lines (not shown) connected, for example to the top drive 46 through the mandrel 66. In certain embodiments, the link tilt cylinders 76 may be double acting to provide drive force sufficient to move the respective elevator link 50 both clockwise and counterclockwise with respect the respective circular trunnions 70 of the link tilt hanger plate 62. Double acting link tilt cylinders 76 assist in driving the elevator links 50 to appropriate positions, for example, to bring a single joint of the tubular element 40 into alignment with, or through in both directions, the central axis of the drilling rig 10 (e.g., through the central axis of the stump 38 of the tubular string 28). In certain embodiments, the link tilt cylinders 76 may be locked into any desired position, again useful in pipe alignment, and may be unlocked to permit substantially unrestricted movement of the elevator links 50.

In operation, the pipe handling device 26 is connected to the top drive 46 (or other suitable drive) of the drilling rig 10, and the single joint elevator 58 is positioned to interact with a single joint of the tubular element 40. In certain embodiments, the pipe handling device 26 is in communication with a controller, such as the controller 78 illustrated in FIG. 1, via electrical and/or hydraulic lines, among other things. The controller 78 may include one or more microprocessor(s) 80 and a memory 82. The memory 82 is a non-transitory (not merely a signal), computer-readable media, which may include executable instructions that may be executed by the microprocessor(s) 80. In general, the controller 78 may be configured to regulate operation of the drilling rig 10, including operation of the pipe handling device 26. In general, it will be appreciated that all, or at least many, of the operational features of the drilling rig 10 described herein may be controlled by the controller 78.

For example, during operation, a single joint of the tubular element 40 may be picked up from the V-door 44 by actuating the link tilt cylinders 76 to drive the pair of elevator links 50, and thereby the single joint elevator 58 connected to the pair of elevator links 50, to a position so that the single joint elevator 58 may be placed around the single joint of the tubular element 40. Once connected, the single joint of the tubular element 40 may be rotated to a vertical position by hoisting the top drive 46 to which the pipe handling device 26 is connected. Then, the single joint of the tubular element 40 may be stabbed into the stump 38 in the rotary table 34, and the link tilt cylinders 76 may be driven to align and maintain alignment of the single joint of the tubular element 40 while the top drive 46 is lowered until an inner surface near the top of the single joint of the tubular element 40 is engaged (e.g., gripped) by the pipe gripping mechanism 60. When lowering the top drive 46, the single joint elevator 58 may slide down the outer surface of the single joint of the tubular element 40 while continuing to hold the single joint of the tubular element 40 upright. Rotational drive may then be applied from the top drive 46 through the mandrel 66 to the pipe gripping mechanism 60.

Figure 3:
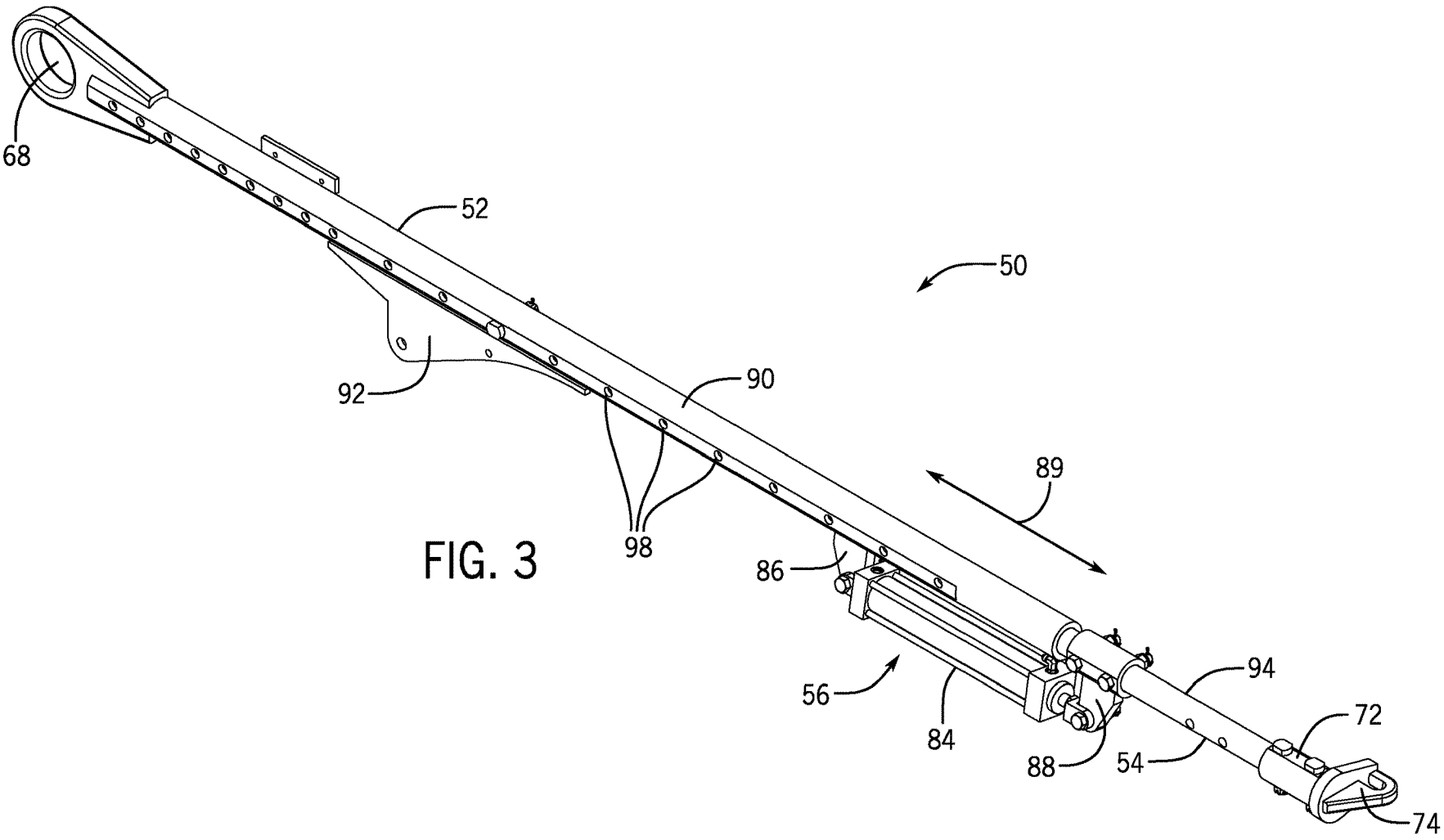
FIG. 3 is a perspective view of an embodiment of an elevator link and respective compensator system of the compensator link assembly of the pipe handling device, in accordance with present techniques.
Figure 4:
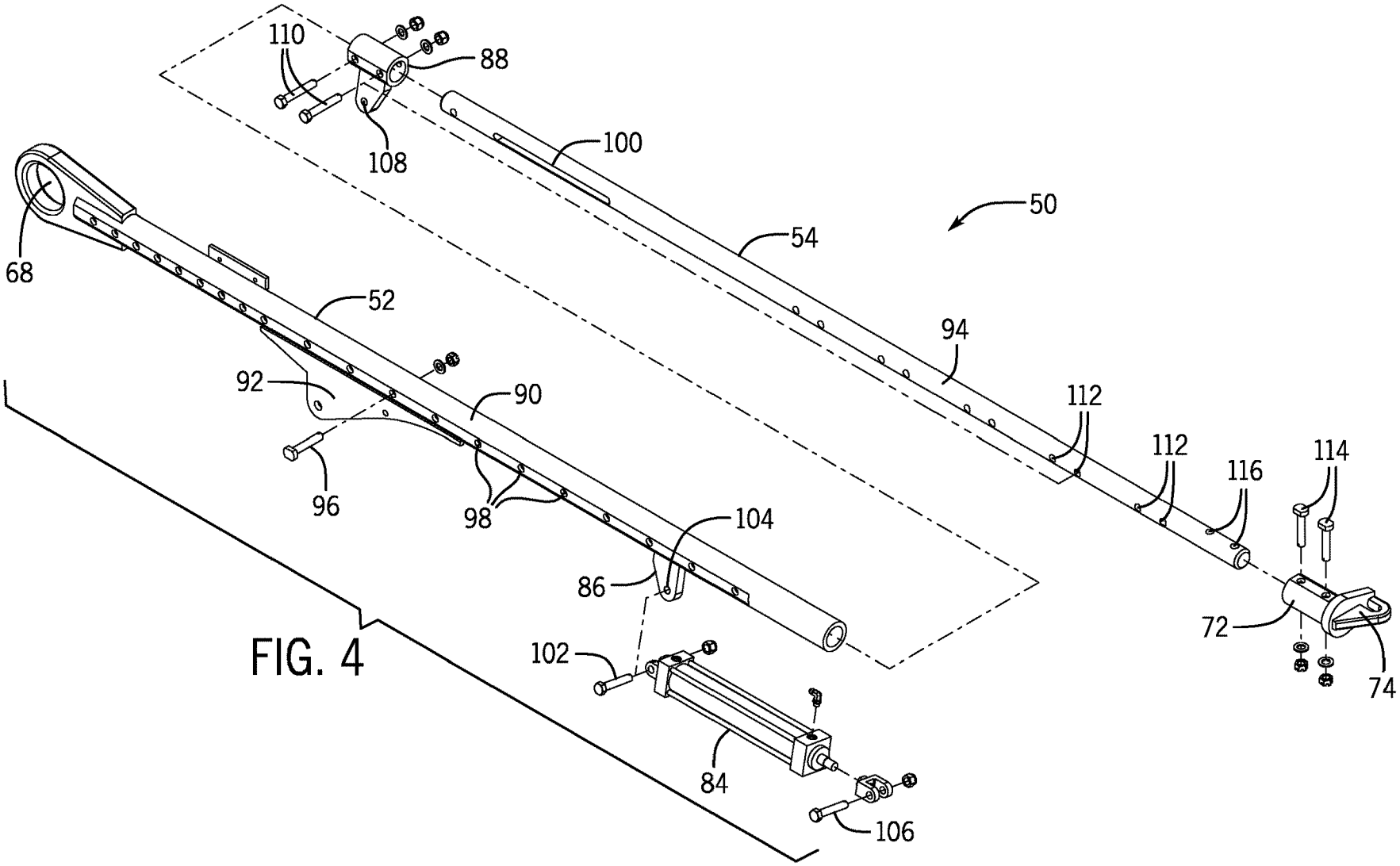
FIG. 4 is an exploded view of the embodiment of the elevator link and respective compensator system illustrated in FIG. 3, in accordance with present techniques.

FIG. 3 is a perspective view of an embodiment of an elevator link 50 and respective compensator system 56 of the compensator link assembly 48 of the pipe handling device 26, in accordance with present techniques. In addition, FIG. 4 is an exploded view of the embodiment of the elevator link 50 and respective compensator system 56 illustrated in FIG. 3, in accordance with present techniques. In particular, FIGS. 3 and 4 illustrate a driller side (DS) elevator link 50 of the compensator link assembly 48. An off-driller side elevator link 50 (not shown) may be similar in structure, just opposite the illustrated elevator link 50. In other words, it will be appreciated that each of the pair of elevator links 50 is associated with a respective compensator system 56, as illustrated in FIGS. 3 and 4.

As discussed above, each of the pair of elevator links 50 may include upper and lower links 52, 54, wherein one of the links 52, 54 is configured to fit telescopically within the other link 52, 54. For example, as illustrated in FIG. 3, in certain embodiments, the lower link 54 may be configured to fit telescopically within the upper link 52. However, in other embodiments, the upper link 52 may be configured to fit telescopically within the lower link 54. As illustrated, in either embodiment, the compensator system 56 may include a compensator cylinder 84 that is attached to the upper link 52 and the lower link 54, respectively, at opposite axial ends of the compensator cylinder 84. In particular, the opposite axial ends of the compensator cylinder 84 may be connected to an upper link cylinder mount 86 attached to the upper link 52 and a lower link cylinder mount 88 attached to the lower link 54, respectively. As such, the compensator cylinder 84 may be configured to adjust an axial position of the lower link 54 within the upper link 52, thereby adjusting a total length of the elevator link 50. In particular, fluid pressure of hydraulic fluid within the compensator cylinder 84 may be adjusted to expand or retract the compensator cylinder 84, as illustrated by arrow 89, to adjust the total length of the elevator link 50.

In certain embodiments, the upper link 52 includes an outer tube 90 with a circular eye hole 68 at an upper axial end of the outer tube 90. As described herein, the circular eye hole 68 is configured to mate with a circular trunnion 70 disposed on the link tilt hanger plate 62 of the pipe handling device 26. As illustrated, two cylinder mounts are attached to the outer tube 90 of the upper link 52—a tilt cylinder mount 92 configured to be connected to a respective link tilt cylinder 76 as described herein, and the upper link cylinder mount 86 configured to be connected to the compensator cylinder 84 of the respective compensator system 56. In addition, in certain embodiments, the lower link 54 includes an inner tube 94 that is attached to a pivot block 72, which may include a pad eye 74 for facilitating connection to the single joint elevator 58 described herein.

In certain embodiments, the inner tube 94 of the lower link 54 fits inside the outer tube 90 of the upper link 52, and moves in and out of the outer tube in a telescopic manner. As illustrated in FIG. 4, in certain embodiments, an upper link bolt 96 is configured to simultaneously fit through any one of a plurality of holes 98 that extend radially through both walls of the outer tube 90 of the upper link 52, as well as a slot 100 through a wall of the inner tube 94 that extends axially along the wall of the inner tube 94 of the lower link 54 when the inner tube 94 of the lower link 54 is disposed within the outer tube 90 of the upper link 52. As such, the upper link bolt 96 may be used to limit the movement and/or stroke of the lower link 54 with respect to the upper link 52 to the length of the slot 100 in the inner tube 94 of the lower link 54.

In certain embodiments, the compensator cylinder 84 may be configured to be attached to the outer tube 90 of the upper link 52 using an upper cylinder bolt 102 that fits into a mating hole 104 of the upper link cylinder mount 86, which may be either integrally formed as part of the outer tube 90, as illustrated, or alternatively removably attached to the outer tube 90 using one or more respective bolts and one or more of the plurality of holes 98 that extend through the outer tube 90. In addition, in certain embodiments, the compensator cylinder 84 may be configured to be attached to the inner tube 94 of the lower link 54 using a lower cylinder bolt 106 that fits into a mating hole 108 of the lower link cylinder mount 88, which may be either integrally formed as part of the inner tube 94 or, alternatively, removably attached to the inner tube 94 using one or more respective bolts 110 and one or more of a plurality of holes 112 that extend radially through a wall of the inner tube 94, as illustrated. In a similar fashion, in certain embodiments, the pivot block 72 may be configured to be attached to the inner tube 94 of the lower link 54 using one or more respective bolts 114 and one or more of a plurality of holes 116 that extend radially through a wall of the inner tube 94.

In certain embodiments, the slot 100 in the inner tube 94 of the lower link 54 may be shorter than the stroke of the compensator cylinder 84. For example, in certain embodiments, the slot 100 may be 15 inches long whereas the stroke of the compensator cylinder 84 may be 16 inches long. As such, this may enable the upper and lower link cylinder mounts 86, 88 to be set up in such a way that the upper link bolt 96 will carry the load hanging on the elevator link 50 (i.e., against an axial edge of the slot 100) before the compensator cylinder 84 is completely loaded up. Therefore, the compensator cylinder 84 will not be considered a component of the load path. Instead, the compensator cylinder 84 may act as a hydraulic spring.

In addition, in certain embodiments, the length of the compensator link assembly 48 may be adjustable. In particular, although the length of the upper and lower links 52, 54 and the stroke of the compensator cylinder 84 may not be adjusted, in certain embodiments, the various holes 98, 104, 108, 112, 116 and the slot 100, in conjunction with the various bolts 96, 102, 106, 110, 114, may enable the length of the compensator link assembly 48 to be adjusted.

In certain embodiments, the compensator link assembly 48 of the pipe handling device 26 may include a hydraulic control system, such as an active hydraulic control system or a passive hydraulic control system. It should be understood that the present embodiments are discussed within the context of hydraulic control, however other types of control may be applicable. For example, the compensator link assembly 48 may include pneumatic, magnetic, and/or spring control systems. It will be appreciated that adjustments to the hydraulic control systems described herein may be at least partially effectuated via the controller 78 described herein. For example, an operator may make adjustments to the hydraulic control systems described herein via interaction with the controller 78 (e.g., via a user interface of the controller 78), which may cause the operator adjustments to be carried out by the components of the hydraulic control systems described herein.

Figure 5:
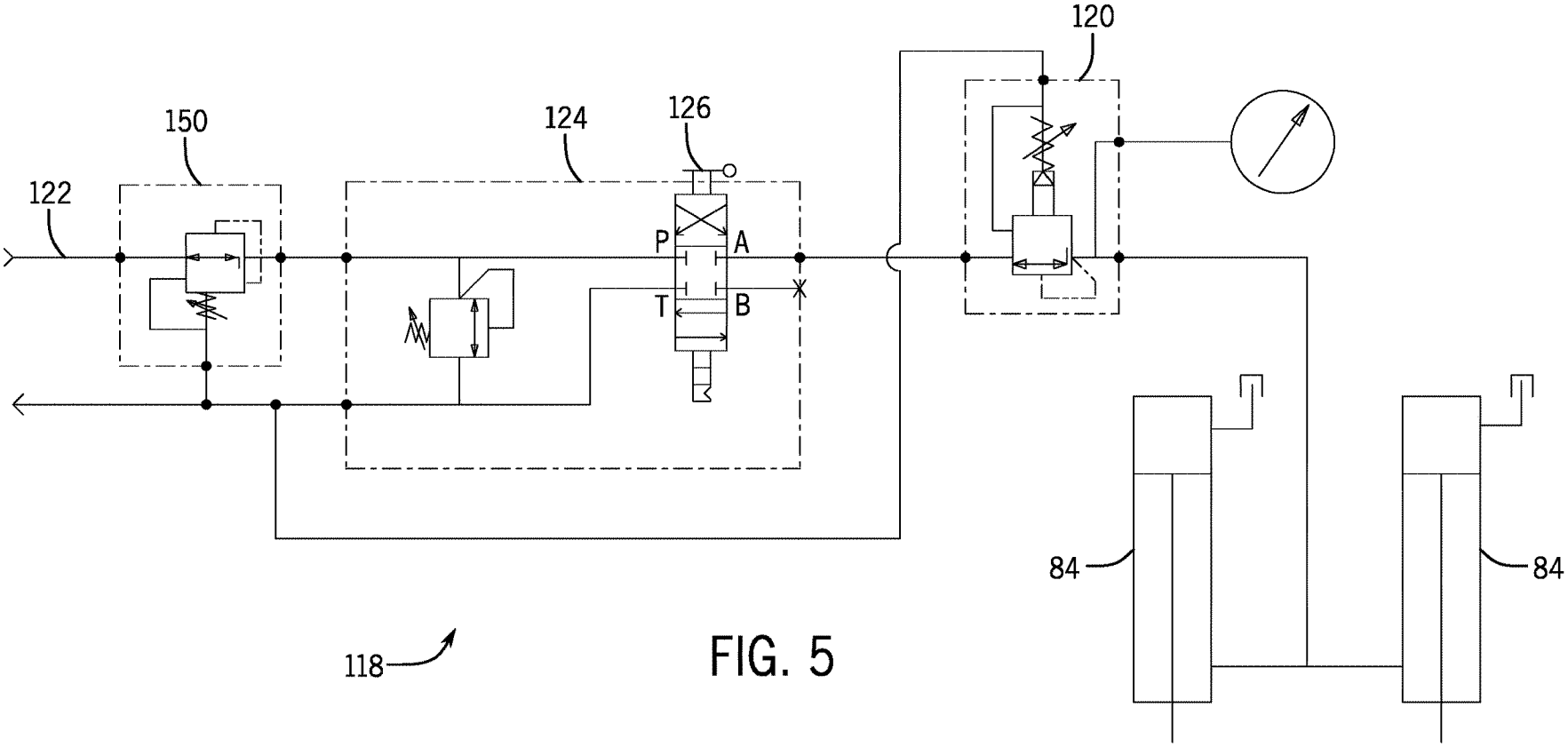
FIG. 5 is a schematic diagram of an embodiment of an active hydraulic control system for the compensator link assembly of the pipe handling device, in accordance with present techniques.

FIG. 5 is a schematic diagram of an embodiment of an active hydraulic control system 118 for the compensator link assembly 48 of the pipe handling device 26, in accordance with present techniques. With the active hydraulic control system 118, an operator may have active control (e.g., continuous active control) of the compensator link assembly 48. For example, the active hydraulic control system 118 may enable the operator to extend or retract the compensator cylinders 84 by operating a hydraulic valve to adjust fluid pressure in the compensator cylinders 84, and thereby extending or retracting the respective elevator links 50 (e.g., by extending or retracting the position of the inner tube 94 of the lower link 54 within the outer tube 90 of the upper link 52).

In addition, in certain embodiments, the operator may adjust a pressure reducing valve 120 to control the hydraulic pressure on the compensator cylinders 84, and thereby compensate for the weight that is hanging on the elevator links 50. In certain embodiments, a supply pressure reducing valve 150 in the pressure line 122 (i.e., the hydraulic line that supplies pressure to the active hydraulic control system 118) may limit the pressure that the compensator cylinders 84 experience and, therefore, limit the force that can be exerted by the compensator cylinders 84. In certain embodiments, the load rating of the compensator cylinders 84 may be on the order of 6 tons. In such an embodiment, the compensator cylinders 84 may not exert more force than a load rating of the elevator links 50. In general, the pressure supplied by the pressure line 122 is between approximately 2,500 psi and approximately 3,000 psi. In certain embodiments, whereas the adjustable pressure reducing valve 120 may be adjusted (e.g., manually) by an operator, the supply pressure reducing valve 150 is not adjustable by an operator.

In certain embodiments, a relief valve in a mono block control valve 124 of the active hydraulic control system 118 may be a secondary protection and may be set slightly higher than the pressure reducing valve 150. The adjustable pressure reducing valve 120 may be used to adjust the pressure in the compensator cylinders 84 so that the force of the compensator cylinders 84 equals the weight of the single joint of the tubular element 40 that is hanging on the single joint elevator 58. The pressure reducing valve 120 may be adjusted so the compensator cylinder force is slightly higher or lower than the weight of the single joint of the tubular element 40.

As described herein, the active hydraulic control system 118 may enable fine control when stabbing the single joint of the tubular element 40 into the stump 38 of the tubular string 28. In this instance, the pressure reducing valve 150 may be set so that the maximum force that can be exerted by the compensator cylinders 84 does not exceed the load rating of the elevator links 50. As a secondary safety, the relief valve in the mono block control valve 124 may be set above (e.g., approximately 200 psi above) the pressure reducing valve 150. In certain embodiments, setting of the valves 124, 150 may be performed in the shop before the tools are sent to a particular drilling rig 10.

When the CDS 24 is rigged up and the casing running operation has begun, the operator may latch the single joint elevator 58 onto a new single joint of the tubular element 40 and signal the driller to hoist the CDS 24 with the single joint of the tubular element 40 using the draw works 16. Once the single joint of the tubular element 40 is suspended vertically from the single joint elevator 58, the CDS operator may completely retract the elevator links 50. For example, in certain embodiments, the elevator links 50 may be retracted by manually moving a control lever 126 such that hydraulic fluid is sent to the compensator cylinders 84. To adjust the pressure reducing valve 120, the operator may retract the elevator links 50 about half way in using the control lever 126. The operator may then back off the pressure reducing valve 120 until the elevator links 50 start to extend slowly. The operator may then turn the pressure reducing valve 120 slightly in until the elevator links 50 barely start to retract. At this point, the single joint of the tubular element 40 is at the neutral weight point. Any additional weight will cause the elevator links 50 to extend, and any reduction in weight will cause the elevator links 50 to retract. In general, this is where the pressure reducing valve 120 should be locked and remain for the rest of the operation.

Once retraction is complete, the driller may then lower the CDS 24 and the single joint of the tubular element 40 until the single joint of the tubular element 40 is a short distance above the stump 38 of the tubular string 28 (e.g., 2 inches above the stump 38 of the tubular string 28). The CDS operator may then slowly lower the single joint of the tubular element 40 further into the box connection of the stump 38 by extending the elevator links 50. Once the threads on the pin end of the single joint of the tubular element 40 contact the thread in the box of the stump 38, lowering of the single joint of the tubular element 40 may be stopped. The weight on the threads of the single joint of the tubular element 40 and the stump 38 may be relatively minimal as the single joint of the tubular element 40 is just below the neutral weight point.

Thereafter, the threaded connection may be made up by hand, by utilizing hydraulic tongs, or other suitable manner. As the threaded connection is made up, the elevator links 50 may be extended to enable the single joint of the tubular element 40 to be lowered further until the connection is made up completely. As the elevator links 50 are extending, the pressure reducing valve 120 may keep the pressure in the compensator cylinders 84 relatively constant and, therefore, the single joint of the tubular element 40 will remain at the neutral weight point. Once the connection is made up, the CDS operator may flag the driller to lower the CDS 24 and stab the CDS 24 into the casing. The CDS 24 may be set and the tubular string 28 may be run into the wellbore 30. In certain embodiments, as the CDS 24 gets closer to the rig floor 12, the single joint elevator 58 may be unlatched from the single joint of the tubular element 40 and moved out of the way, for example, using the pair of link tilt cylinders 76. The single joint elevator 58 is then ready to be latched onto the next single joint of the tubular element 40, and the process may start again.

Figure 6:
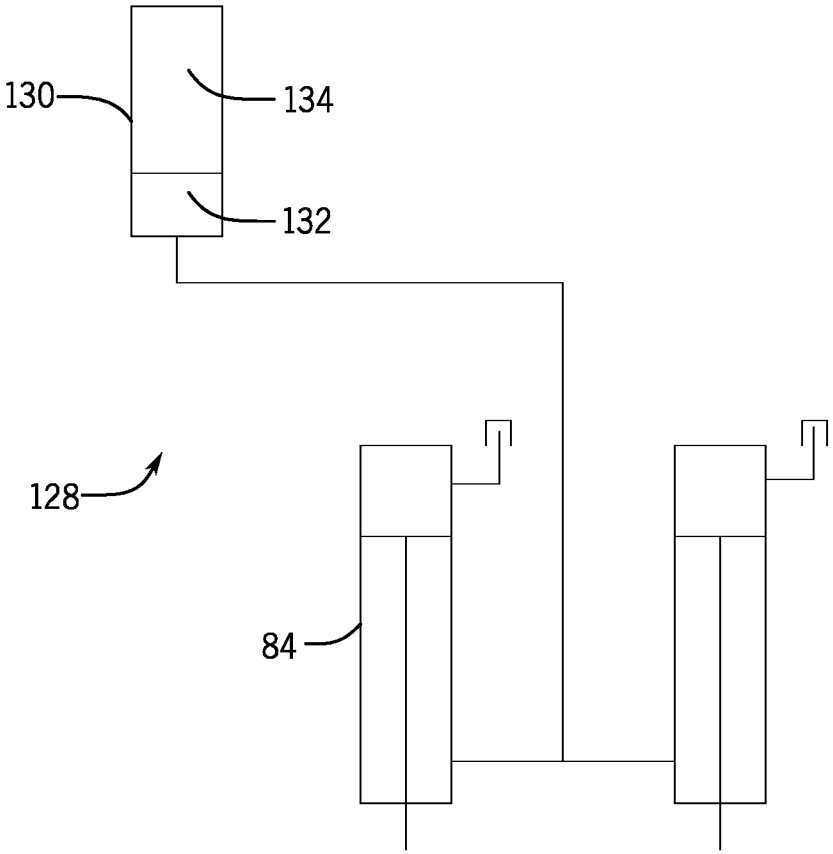
FIG. 6 is a schematic diagram of an embodiment of a passive hydraulic control system for the compensator link assembly of the pipe handling device, in accordance with present techniques.

FIG. 6 is a schematic diagram of an embodiment of a passive hydraulic control system 128 for the compensator link assembly 48 of the pipe handling device 26, in accordance with present techniques. With the passive hydraulic control system 128, the controls may be set in advance of commencement of a job performed by the drilling rig 10. In general, the passive hydraulic control system 128 may not involve any interaction by the operator during use, but rather may automatically adjust fluid pressure in the compensator cylinders 84 without operator intervention, for example. In certain embodiments, the passive hydraulic control system 128 may include a gas (e.g., nitrogen) pre-charged accumulator 130 that may be attached to the elevator links 50, for example, using a bracket (not shown). The accumulator 130 may provide hydraulic pressure to the rod side of the compensator cylinders 84.

The setup of the passive hydraulic control system 128 may involve pre-charging the accumulator 130 to provide hydraulic pressure to the compensator cylinders 84 such that the compensator cylinders 84 are stroked out approximately half way when the single joint of the tubular element 40 is hanging on the elevator links 50. If more weight is put on the elevator links 50, the compensator cylinders 84 may stroke out. If weight is removed from the elevator links 50, the compensator cylinders 84 will stroke in. In this sense, the accumulator 130 may act as a spring. Sizing of the accumulator 130 is selected to achieve the desired amount of "spring" without exceeding the pressure rating of any of the hydraulic components. For example, the ratio between the cylinder volume and accumulator volume may be between approximately 1:1.2 and approximately 1:1.5.

When the CDS 24 is rigged up and the casing running operation has begun, the operator may latch the single joint elevator 58 onto a new single joint of the tubular element 40 and signal the driller to hoist the CDS 24 with the single joint of the tubular element 40 using the draw works 16. As the single joint elevator 58 lifts the weight of the single joint of the tubular element 40, the elevator links 50 may extend and hydraulic fluid 132 may be forced out of the compensator cylinders 84 and into the accumulator 130, compressing the gas 134 in the accumulator 130. Hydraulic fluid 132 may continue flowing out of the compensator cylinders 84 into the accumulator 130 until the force exerted by the gas 134 in the accumulator 130 equals the weight of the single joint of the tubular element 40. At this point, the elevator links 50 stop extending. If the gas pre-charge in the accumulator 130 was setup in the manner described above, the elevator links 50 will be approximately halfway through their stroke, and the single joint of the tubular element 40 will be at its neutral weight point. Once the single joint of the tubular element 40 hangs vertical, the driller may lower the CDS 24 and the single joint of the tubular element 40, and stab the pin end of the single joint of the tubular element 40 into the box end of the stump 38. The weight on the threads of the single joint of the tubular element 40 and the stump 38 may be relatively minimal as the casing is at its neutral weight point.

At this point, hydraulic tongs or other tool may be engaged, and the threaded connection may be made up. As the threaded connection is screwed together, the single joint of the tubular element 40 may be pulled down and the elevator links 50 will extend. This will cause more hydraulic fluid 132 to flow out of the compensator cylinders 84 and into the accumulator 130, increasing the gas pressure inside the accumulator 130. The force exerted now by the gas 134 may be more than the weight of the casing, and the casing may experience an upwards pull by the elevator links 50 as the accumulator 130 may act as a hydraulic spring. In certain situations, the driller may lower the CDS 24 as the connection is made up. However, if not, the elevator links 50 may provide some flexibility. After the threaded connection is made up, the CDS 24 may be lowered and stabbed into the casing. The CDS 24 may be set and the tubular string 28 may be run into the wellbore 30. In certain embodiments, as the CDS 24 gets closer to the rig floor 12, the single joint elevator 58 may be unlatched from the single joint of the tubular element 40 and moved out of the way, for example, using the pair of link tilt cylinders 76. The single joint elevator 58 is then ready to be latched onto the next single joint of the tubular element 40, and the process may start again.

Whether utilizing an active hydraulic control system 118 (e.g., FIG. 5) or a passive hydraulic control system 128 (e.g., FIG. 6), the compensator link assembly 48 of the pipe handling device 26 may provide a safety mechanism for instances in which more weight is being lifted than the load rating of the link components (e.g., if the whole casing string is being lifted). If the elevator links 50 are retracted to a point where the single joint of the tubular element 40 has reached a neutral weight point, any additional weight would cause the elevator links 50 and the compensator cylinders 84 to extend and stroke out. This may be a visual cue to the operator that too much weight is trying to be lifted before any of the components degrade. Further, the control systems (e.g., hydraulic control systems) 118, 128 may be coupled to a feedback mechanism that may provide a visual and/or audible feedback, such as an alarm, that may warn an operator when too much weight is lifted by the elevators. For example, in certain embodiments, a pressure switch may be set slightly below the pressure that may be applied to the compensator cylinders 84 for the weight of a single joint of the tubular element 40, such as 6 tons. This setting may act as a threshold that, when exceeded, may signal an alarm.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A system, comprising:

a joint elevator configured to engage a joint of a tubular element;

an elevator link comprising an upper link and a lower link, wherein the lower link is configured to couple to the joint elevator, and wherein the lower link is configured to fit telescopically within the upper link;

a link bolt which simultaneously extends radially through the upper link and the lower link; and a compensator cylinder, attached to the upper link and the lower link, respectively, at opposite axial ends of the compensator cylinder, wherein extension of the compensator cylinder extends the elevator link and retraction of the compensator cylinder retracts the elevator link while the link bolt extends radially through the upper link and the lower link.

2. The system of claim 1, wherein the lower link is configured to move axially within the upper link, and wherein the compensator cylinder is configured to adjust an axial position of the lower link with respect to the upper link.

3. The system of claim 2, wherein the upper link comprises a plurality of holes that extend radially through the upper link, and the lower link comprises a slot that extends axially along a length of the lower link, wherein the relative axial position of the lower link with respect to the upper link is adjustable via engagement of the link bolt with one of the plurality of holes of the upper link and with the slot of the lower link.

4. The system of claim 3, wherein the compensator cylinder is configured to adjust the axial position of the lower link with respect to the upper link so as to adjust the total length of the elevator link.

5. The system of claim 4, wherein the slot is configured to limit an expansion or contraction of the lower link with respect to the upper link.

6. The system of claim 5, wherein the length of the slot is shorter than a stroke of the compensator cylinder.

7. The system of claim 1, comprising a pair of the elevator links, each one of the elevator links comprising an upper link and a lower link, and a pair of compensator cylinders, each compensator cylinder configured to couple to the upper link and the lower link of a respective one of the elevator links.

8. The system of claim 1, comprising a hydraulic control system configured to adjust a fluid pressure within the compensator cylinder to expand or retract the compensator cylinder.

9. The system of claim 8, wherein the hydraulic control system comprises an active hydraulic control system configured to adjust the fluid pressure based at least in part on manual actuation of a control valve of the active hydraulic control system.

10. The system of claim 9, wherein the active hydraulic control system comprises an adjustable pressure reducing valve configured to regulate the fluid pressure between the control valve and the compensator cylinder.

11. The system of claim 8, wherein the hydraulic control system comprises a passive hydraulic control system configured to adjust the fluid pressure automatically without operator intervention.

12. The system of claim 11, wherein the passive hydraulic control system comprises a pre-charged piston accumulator configured to provide the fluid pressure to the compensator cylinder.

13. A system, comprising:

a joint elevator configured to engage a joint of a tubular element;

an elevator link comprising an upper link and a lower link, wherein the lower link is configured to couple to the joint elevator, and wherein the lower link is configured to fit telescopically within the upper link;

a link bolt which simultaneously extends radially through the upper link and the lower link;

a compensator cylinder, attached to the upper link and the lower link, respectively, at opposite axial ends of the compensator cylinder, wherein extension of the compensator cylinder extends the elevator link and retraction of the compensator cylinder retracts the elevator link while the link bolt extends radially through the upper link and the lower link; and a hydraulic control system configured to adjust a fluid pressure within the compensator cylinder to expand or retract the compensator cylinder.

14. The system of claim 13, wherein the hydraulic control system comprises an active hydraulic control system configured to adjust the fluid pressure based at least in part on manual actuation of a control valve of the active hydraulic control system.

15. The system of claim 14, wherein the active hydraulic control system comprises an adjustable pressure reducing valve configured to regulate the fluid pressure between the control valve and the compensator cylinder.

16. The system of claim 13, wherein the hydraulic control system comprises a passive hydraulic control system configured to adjust the fluid pressure automatically without operator intervention.

17. The system of claim 16, wherein the passive hydraulic control system comprises a pre-charged piston accumulator configured to provide the fluid pressure to the compensator cylinder.

18. The system of claim 13, wherein the lower link is configured to move axially within the upper link, and wherein the compensator cylinder is configured to adjust an axial position of the lower link with respect to the upper link.

19. The system of claim 13, wherein the upper link comprises a circular eye hole disposed at an axial end of the upper link, and wherein the elevator link is configured to pivot relative to an axis of the circular eye hole.

20. The system of claim 13, wherein the upper link comprises a plurality of holes that extend radially through the upper link, and the lower link comprises a slot that extends axially along a length of the lower link, wherein a relative axial position of the lower link with respect to the upper link is adjustable via engagement of a link bolt with one of the plurality of holes of the upper link and with the slot of the lower link.

* * * * *